US008460031B2

(12) United States Patent
Paynter et al.

(10) Patent No.: US 8,460,031 B2
(45) Date of Patent: Jun. 11, 2013

(54) COAXIAL CONNECTOR WITH CABLE DIAMETER ADAPTING SEAL ASSEMBLY AND INTERCONNECTION METHOD

(75) Inventors: Jeffrey D Paynter, Momence, IL (US); Lawrence J Buenz, Frankfort, IL (US)

(73) Assignee: Andrew LLC, Hickory, NC (US)

( * ) Notice: Subject to any disclaimer, the term of this patent is extended or adjusted under 35 U.S.C. 154(b) by 246 days.

(21) Appl. No.: 13/151,078

(22) Filed: Jun. 1, 2011

(65) Prior Publication Data

US 2011/0230093 A1 Sep. 22, 2011

Related U.S. Application Data

(63) Continuation-in-part of application No. 12/886,940, filed on Sep. 21, 2010, which is a continuation-in-part of application No. 12/611,095, filed on Nov. 2, 2009, now Pat. No. 7,927,134, which is a continuation-in-part of application No. 12/264,932, filed on Nov. 5, 2008, now Pat. No. 7,806,724.

(51) Int. Cl.
*H01R 9/05* (2006.01)

(52) U.S. Cl.
USPC ..... 439/584

(58) Field of Classification Search
USPC ..... 439/578–585
IPC ..... H01R 24/38
See application file for complete search history.

(56) References Cited

U.S. PATENT DOCUMENTS

| | | | | |
|---|---|---|---|---|
| 3,671,926 A | | 6/1972 | Nepovim | |
| 3,744,011 A | | 7/1973 | Blanchenot | |
| 3,757,279 A | | 9/1973 | Winston | |
| 3,761,870 A | | 9/1973 | Drezin et al. | |
| 4,350,840 A | | 9/1982 | Michaels | |
| 4,515,991 A | | 5/1985 | Hutchison | |
| 4,525,000 A | | 6/1985 | Bachle | |
| 4,549,755 A | | 10/1985 | Kot et al. | |
| 4,824,400 A | * | 4/1989 | Spinner | 439/578 |
| 4,923,412 A | | 5/1990 | Morris | |
| 5,059,747 A | | 10/1991 | Bawa et al. | |
| 5,137,470 A | | 8/1992 | Doles | |
| 5,267,877 A | * | 12/1993 | Scannelli et al. | 439/584 |
| 5,322,454 A | | 6/1994 | Thommen | |
| 5,352,134 A | | 10/1994 | Jacobsen et al. | |
| 5,795,188 A | | 8/1998 | Harwath | |
| 5,944,556 A | | 8/1999 | Wlos et al. | |
| 5,951,327 A | | 9/1999 | Marik | |
| 5,967,852 A | | 10/1999 | Follingstad et al. | |

(Continued)

FOREIGN PATENT DOCUMENTS

WO 2004055943 7/2004

*Primary Examiner* — Vanessa Girardi

(74) *Attorney, Agent, or Firm* — Babcock IP, PLLC

(57) ABSTRACT

A coaxial connector for interconnection with a coaxial cable provided with a connector body and a clamp ring dimensioned to couple with a cable end of the connector body. The clamp ring and the connector body provided with a bore along a longitudinal axis therethrough. A gasket with a radially inward protrusion coupled to an inner diameter of the clamp ring. An outer diameter sidewall of the radially inward protrusion and an inner diameter sidewall of the gasket forming an annular gasket groove open to a connector end of the clamp ring. An annular shim seated within the bore; the shim contacting the gasket groove, biasing the radially inward protrusion radially inward, as the clamp ring is advanced toward the connector body along the longitudinal axis.

20 Claims, 4 Drawing Sheets

U.S. PATENT DOCUMENTS

| | | | | |
|---|---|---|---|---|
| 6,019,636 | A | 2/2000 | Langham | |
| 6,071,144 | A | 6/2000 | Tang | |
| 6,080,015 | A | 6/2000 | Andreescu | |
| 6,808,415 | B1 | 10/2004 | Montena | |
| 6,848,939 | B2 | 2/2005 | Stirling | |
| 6,939,169 | B2 | 9/2005 | Islam et al. | |
| 6,976,872 | B1 | 12/2005 | Wild et al. | |
| 7,011,546 | B2 | 3/2006 | Vaccaro | |
| 7,077,699 | B2 | 7/2006 | Islam et al. | |
| 7,080,998 | B2 | 7/2006 | Hall et al. | |
| 7,156,696 | B1 | 1/2007 | Montena | |
| 7,249,969 | B2 | 7/2007 | Paynter | |
| 7,297,023 | B2 | 11/2007 | Chawgo | |
| 7,329,149 | B2 | 2/2008 | Montena | |
| 7,335,059 | B2 | 2/2008 | Vaccaro | |
| 7,438,327 | B2 | 10/2008 | Auray et al. | |
| 7,506,831 | B1 | 3/2009 | Weiner | |
| 7,566,831 | B2 | 7/2009 | Holland | |
| 7,690,945 | B2 | 4/2010 | Petersen | |
| 7,794,275 | B2 | 9/2010 | Rodrigues | |
| 7,828,596 | B2 | 11/2010 | Malak | |
| 2004/0077215 | A1 | 4/2004 | Palinkas et al. | |
| 2004/0082218 | A1 | 4/2004 | Stirling | |
| 2005/0164552 | A1 | 7/2005 | Wlos et al. | |
| 2006/0211304 | A1 | 9/2006 | Holland | |
| 2008/0274644 | A1* | 11/2008 | Rodrigues | 439/583 |
| 2009/0325420 | A1 | 12/2009 | Paynter | |
| 2010/0112853 | A1* | 5/2010 | Paynter et al. | 439/578 |
| 2010/0178800 | A1 | 7/2010 | Clausen | |
| 2011/0021074 | A1 | 1/2011 | Paynter et al. | |

* cited by examiner

COAXIAL CONNECTOR WITH CABLE DIAMETER ADAPTING SEAL ASSEMBLY AND INTERCONNECTION METHOD

CROSS REFERENCE TO RELATED APPLICATIONS

This application is a continuation-in-part of commonly owned U.S. Utility patent application Ser. No. 12/886,940, titled "Self Gauging Insertion Coupling Coaxial Connector", filed Sep. 21, 2010 by Jeffrey Paynter and Nahid Islam, currently pending, hereby incorporated by reference in its entirety, which is a continuation-in-part of commonly owned U.S. Pat. No. 7,927,134, titled "Coaxial Connector for Cable with a Solid Outer Conductor", issued Apr. 19, 2011 to Jeffrey Paynter and Al Cox, hereby incorporated by reference in its entirety, which is a continuation-in-part of commonly owned U.S. Pat. No. 7,806,724, titled "Coaxial Connector for Cable with a Solid Outer Conductor", issued Oct. 5, 2010 to Jeffrey Paynter and Al Cox, hereby incorporated in its entirety.

BACKGROUND OF THE INVENTION

1. Field of the Invention

This invention relates to electrical cable connectors. More particularly, the invention relates to a coaxial connector with an environmental seal arrangement that adapts to seal against coaxial cables with a range of outer conductor diameters.

2. Description of Related Art

Coaxial cable connectors are used, for example, in communication systems requiring a high level of precision and reliability.

Coaxial connectors are commonly provided with annular gaskets for sealing between the coaxial connector and a coaxial cable. However, the ability of such gaskets to seal against the outer diameter of the outer conductor and/or jacket of coaxial cables having varying diameters is typically limited by the material properties, particularly the elasticity, of the gasket. Further, to achieve a tight seal, the dimensions of the gasket may be increased. However, increased interference resulting from an enlarged gasket may make it more difficult to insert the coaxial cable past the gasket during assembly.

Alternative sealing solutions include a distortable or compressible grommet placed within the bore of the connector that is compressed by mechanical action during interconnection. However, such solutions remain limited by the properties, particularly the elasticity, of the sealing material.

Other solutions provide a tapered gasket/grommet and/or a tapered inner diameter of a connector for advancing the gasket/grommet axially until sealing is achieved. However, movable seals increase the surface area of the sealing surfaces, which may create a greater potential for leakage and/or seal degradation.

Competition in the coaxial cable connector market has focused attention on improving electrical and environmental performance and minimization of overall costs, including materials costs, training requirements for installation personnel, reduction of dedicated installation tooling and the total number of required installation steps and/or operations.

Therefore, it is an object of the invention to provide a coaxial cable connector that overcomes deficiencies in the prior art.

BRIEF DESCRIPTION OF THE DRAWINGS

The accompanying drawings, which are incorporated in and constitute a part of this specification, illustrate embodiments of the invention, together with a general description of the invention given above, and the detailed description of the embodiments given below, serve to explain the principles of the invention. Like reference numbers in the drawing figures refer to the same feature or element and may not be described in detail for every drawing figure in which they appear.

DETAILED DESCRIPTION

Figure 1:
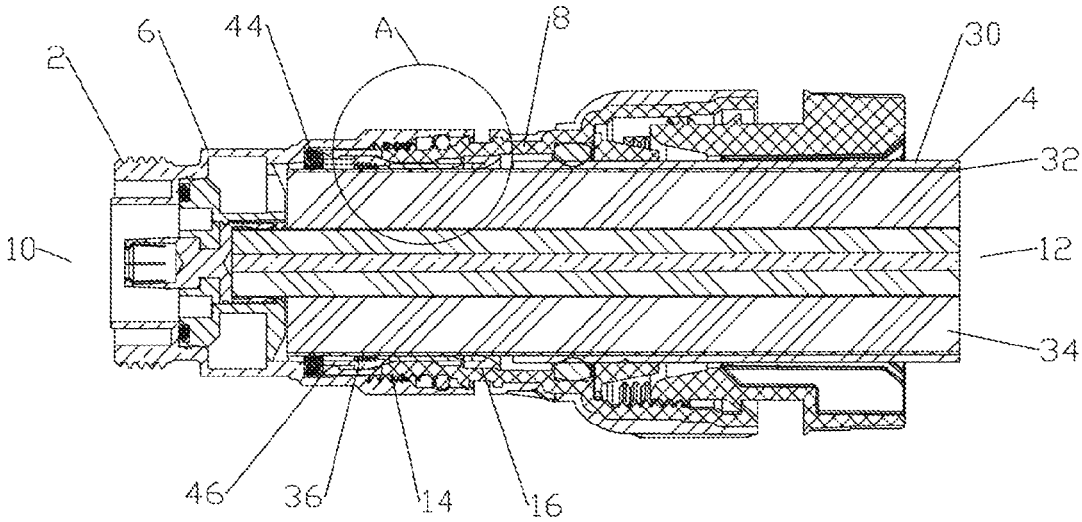
FIG. 1 is a schematic cross-section side view of a first exemplary coaxial connector interconnected with a coaxial cable prior to axial advance of the clamp ring.

The inventors have analyzed available solid outer conductor coaxial connectors and recognized the drawbacks of threaded inter-body connection(s), manual flaring installation procedures and crimp/compression coaxial connector designs. Insertion coupling type coaxial connectors, for example as disclosed in the inventor's commonly owned U.S. Pat. Nos. 7,806,724 and 7,927,134 titled "Coaxial Connector for Cable with Solid Outer Conductor", issued Oct. 5, 2010 and Apr. 19, 2011, respectively, introduce several significant improvements to the coaxial connector arts, eliminating the need for manual flaring of the outer conductor and/or high torque threading of the coupling nut into the connector body during outer conductor end clamping connector to cable end interconnection.

One skilled in the art will appreciate that the outer diameter of coaxial cables can vary. For example, the outer diameter of a coaxial cable made by one manufacturer may differ from the outer diameter of a coaxial cable made by another manufacturer. The inventor's electrical performance analysis of the prior insertion coupling coaxial connectors revealed that a variance in the diameter of the outer conductor of a coaxial cable can negatively impact both the quality of the electrical interconnection formed via contact between a helical spring coil outer conductor electrical contact and the outer conductor and the quality of the environmental seal between the coaxial connector and the coaxial cable outer diameter.

The inventors have recognized that seal quality may be improved, and a wider range of coaxial cable diameters accommodated, by mechanically displacing a radially inward protrusion of a gasket. The inventors have further recognized that providing mechanical displacement of an axially stationary gasket, with a permanently sealed surface and a dynamic surface, can provide greater seal protection by reducing the number of dynamic surfaces along which dynamic sealing is required.

In the exemplary embodiments of FIGS. 1-8, a coaxial connector 2 for interconnection with a coaxial cable 4 is provided with a connector body 6 and a clamp ring 8. A connector end 10 of the clamp ring 8 is dimensioned for coupling with a cable end 12 of the connector body 6. The connector end 10 of the clamp ring 8 and the cable end 12 of the connector body 6 may each, for example, be provided with a thread 14 for screwing together the clamp ring 8 and the connector body 6. The clamp ring 8 and the connector body 6 are each provided with an inner diameter, forming a bore 16 of the clamp ring 8 and the connector body 6.

One skilled in the art will appreciate that connector end 10 and cable end 12 are applied herein as identifiers for respective ends of both the coaxial connector 2 and also of discrete elements of the coaxial connector 2 described herein, to identify the same and their respective interconnecting surfaces according to their alignment along a longitudinal axis of the coaxial connector 2 between a connector end 10 and a cable end 12.

Figure 6:
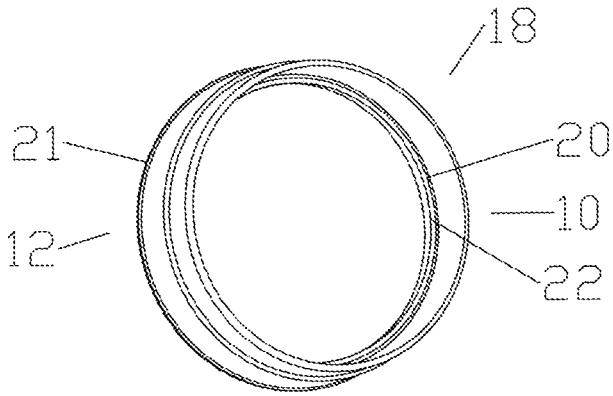
FIG. 6 is a schematic isometric view of the gasket of the coaxial connector of FIG. 1.

A gasket 18, for example as shown in FIG. 6, provided with a radially inward protrusion 20 is retained within an inner diameter of the clamp ring 8. To maintain an axially stationary position, the gasket 18 may, for example, be molded inside of the inner diameter of the clamp ring 8. To further anchor the gasket 18, the gasket 18 may be provided with an outer diameter gasket flange 21 which keys with a corresponding retention groove 19 of the clamp ring 8.

When the coaxial cable 4 is inserted through a cable end 12 of the clamp ring 8, the radially inward protrusion 20 is driven toward a connector end 10 of the clamp ring 8, forming an annular gasket groove 22 between a sidewall of the radially inward protrusion 20 and a sidewall of the gasket 18, the gasket groove 22 being open to the connector end 10 of the gasket 18.

Figure 5:
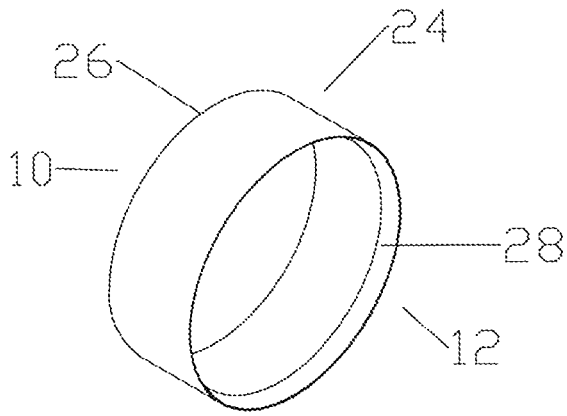
FIG. 5 is a schematic isometric view of the shim of the coaxial connector of FIG. 1.

A annular shim 24 may also be retained within the bore 16. As best shown in FIG. 5, the shim 24 may be provided with a base shim end 26 and a tapered shim end 28. The base shim end 26, for example, may be dimensioned for abutting the connector body 6 or other feature in communication with the connector body 6, and the tapered shim end 28 may be dimensioned for coupling with the gasket 18 within the gasket groove 22. When the clamp ring 8 is brought together with the connector body 6 for coupling, the shim 24 and the gasket 18 are also brought together, seating the shim 24 within the gasket groove 22. Upon seating within the gasket groove 22, the tapered shim end 28 progressively displaces the radially inward protrusion 20 radially inward.

The gasket 18 may be provided between the inner diameter of the clamp ring 8 and an outer diameter of the coaxial cable 4. Depending upon the desired sealing surface and/or cable end preparation, the outer diameter of the coaxial cable 4 may, for example, be the jacket 30 or outer conductor 32 of the coaxial cable 4. Accordingly, the radially inward protrusion 20, when displaced by the cable insertion there past, is biased against, for example, the outer conductor 32 of the coaxial cable 4. The tapered shim end 28 within the gasket groove 22 also transmits pressure to an outer diameter of the gasket 18, providing additional sealing between the clamp ring 8 and the coaxial cable 4.

Figure 2:
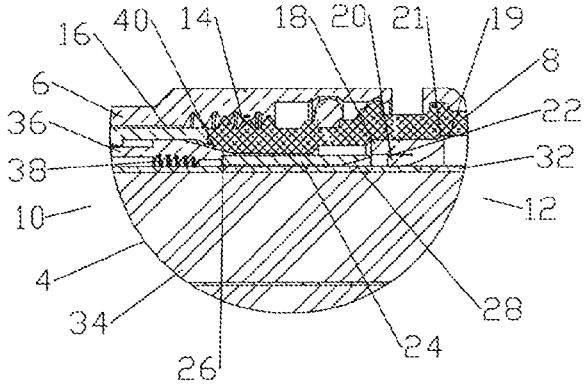
FIG. 2 is an expanded view of section A of FIG. 1.

In the exemplary embodiment of FIGS. 1-6, the coaxial connector 2 is dimensioned for interconnection via insertion coupling. As best shown in FIGS. 1 and 2, a grip ring 36 is provided within the bore 16 and the base shim end 26 of the shim 24 abuts the cable end of the grip ring 36. An inner diameter of the grip ring 36 is provided with a grip surface 38 for securely contacting an outer conductor 32. An outer diameter of the grip ring 38 proximate a cable end 12 of the grip ring 38 is dimensioned to abut a wedge surface 40 of the clamp ring 8. The wedge surface 40 tapers between a maximum diameter proximate the connector end 10 of the clamp ring 8 and a minimum diameter proximate a cable end 12 of the clamp ring 8. Advancing the clamp ring 8 axially toward the connector body 6 drives the outer diameter of the grip ring 36 against the wedge surface 40, displacing the grip ring 36 radially inward into contact with the outer conductor 32. The displacement of the grip ring 36 along the wedge surface in the axial direction is proportional to an outer diameter of the outer conductor 32. Thereby, the shim 24 will also have a displacement in the axial direction proportional to an outer diameter of the outer conductor 32, resulting in insertion of the tapered shim end 28 into the gasket groove 22 to a degree corresponding to the outer diameter of the outer conductor 32, resulting in a radially inward bias of the radially inward protrusion 20 against the outer diameter of the outer conductor 32 that is proportional to the outer diameter of the outer conductor 32.

Figure 3:
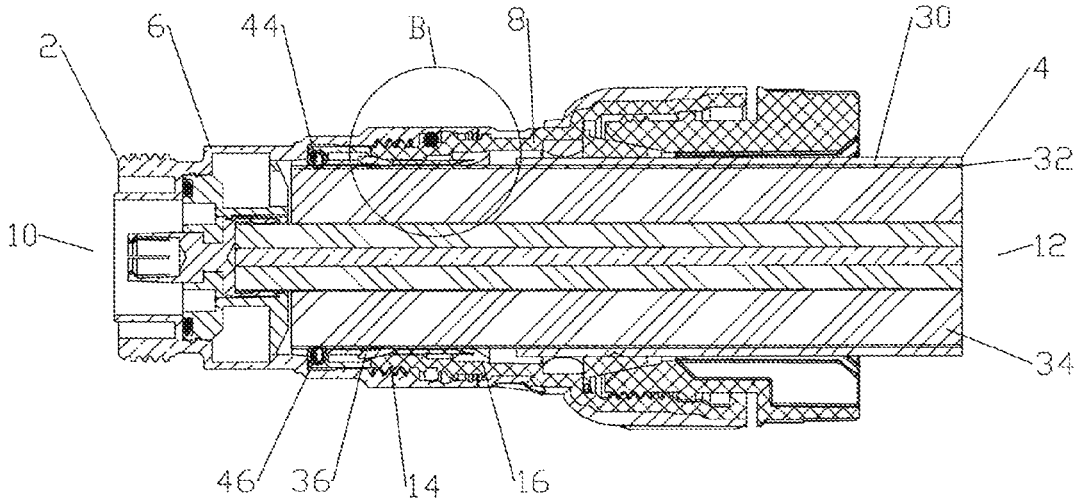
FIG. 3 is a schematic cross-section side view of the coaxial connector of FIG. 1 after axial advance of the clamp ring.

The coaxial connector 2, as depicted in the exemplary embodiment of FIGS. 1-6, may also be provided with an electrical contact 44 retained within the bore, as best shown in FIGS. 1 and 3. The electrical contact 44 may, for example, be a helical coil spring. An inner diameter of the electrical contact 44 is coupled with an outer diameter of the outer conductor 32. A ramp surface 46 for driving the electrical contact 44 radially inward may be coupled with an outer diameter of the electrical contact 44. The ramp surface 46 may, for example, be a portion of the clamp ring 8 proximate the connector end 10 of the clamp ring 8. Thereby, the displacement of the electrical contact 44, grip ring 36 and the inward bias applied to the radially inward protrusion of the gasket 18 are each proportional to an outer diameter of the outer conductor 32.

Figure 7:
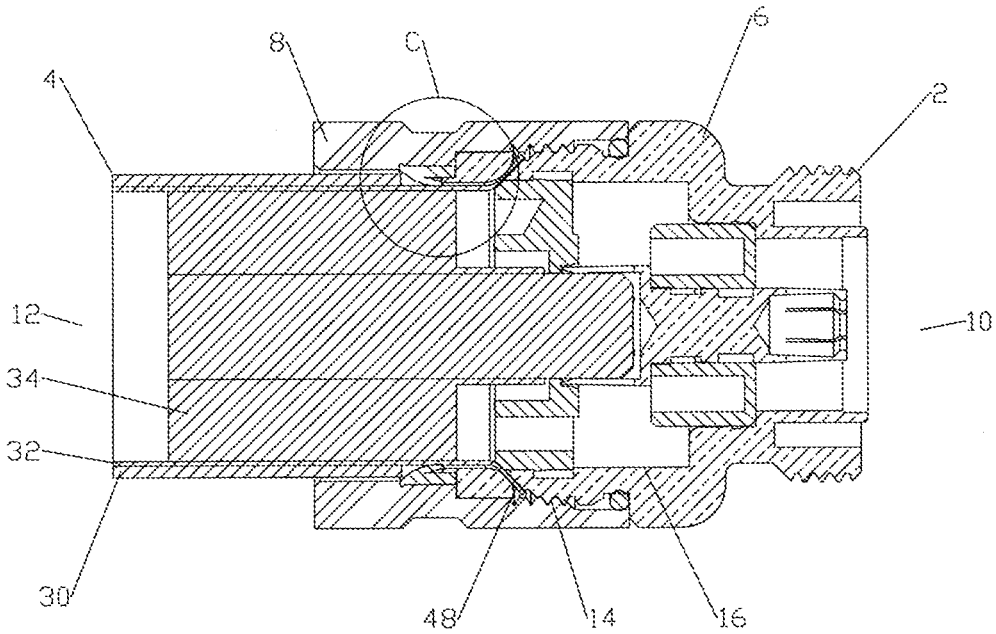
FIG. 7 is a schematic partial cross-section side view of a second exemplary embodiment of a coaxial connector interconnected with a coaxial cable.
Figure 8:
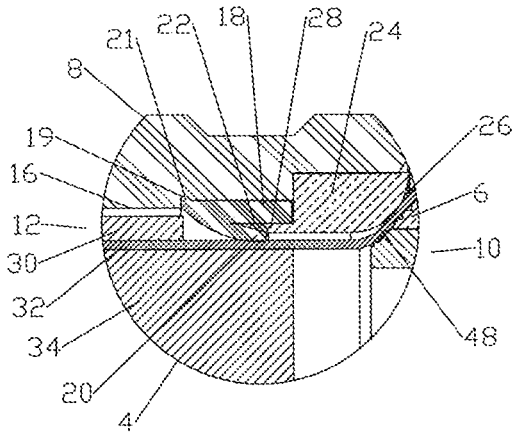
FIG. 8 is an expanded view of section C of FIG. 7.

Although demonstrated upon an insertion coupling type coaxial connector, one skilled in the art will appreciate that an insertion coupling connector configuration is not a requirement. For example, as shown in FIGS. 7 and 8, a connector 2 is provided with a gasket 18. The coaxial connector 2 is dimensioned to couple with a flared portion 48 of an outer conductor 32 of a coaxial cable 4. As best shown in FIG. 8, the flared portion 48 of the outer conductor 32 may, for example, be coupled between a base shim end 26 of the shim 24 and a cable end 12 of the connector body 6. The height and depth of the gasket groove 22, formed by insertion of the coaxial cable 4 through the clamp ring 8, is dependent upon the diameter of the coaxial cable 4, the height and depth of the gasket groove 22 increasing as the diameter of the coaxial cable 4 decreases and decreasing as the diameter of the coaxial cable 4 increases. Thus, the degree of advancement of the shim 24 into the gasket groove 22 is determined by the height and depth and the gasket groove 22, which in turn, is proportional to the diameter of the coaxial cable 4. When the connector body 6 and clamp ring 8 are brought together for coupling, the shim 24 is driven into the gasket groove 22 by the connector body 6, displacing the radially inward protrusion 20 radially inward to couple with the coaxial cable 4.

The gasket 18 may be molded within the inner diameter of the clamp ring 8. Thereby, the gasket 18 has a dynamic sealing surface only along the inner diameter directly against the outer diameter of the coaxial cable 4, as the molding of the gasket 18 upon the inner diameter of the clamp ring 8 provides a permanent seal between the inner diameter of the clamp ring 8 and the outer diameter of the gasket 18. Alternatively, a previously formed gasket 18 may be inserted into the inner diameter of the clamp ring 8, coupling the gasket flange 21 with the retention groove 19 of the clamp ring 8.

In a method for interconnection for the coaxial connector 2 according to the embodiment of FIGS. 1-6, a pre-assembled coaxial connector 2 is provided with the shim seated between the connector body 6 and the clamp ring 8 with the gasket 18 seated in the inner diameter of the clamp ring bore. The end of the coaxial cable 4 has a portion of the jacket 30 stripped to expose a desired portion of the outer conductor 32. The coaxial cable 4 is inserted through the cable end 12 of the clamp ring 8 into the inner diameter of the clamp ring 8, thereby bending the radially inward protrusion 20 toward a connector end 10 of the clamp ring and forming an annular gasket groove 22 between a sidewall of the radially inward protrusion 20 and a sidewall of the gasket 18.

Figure 4:
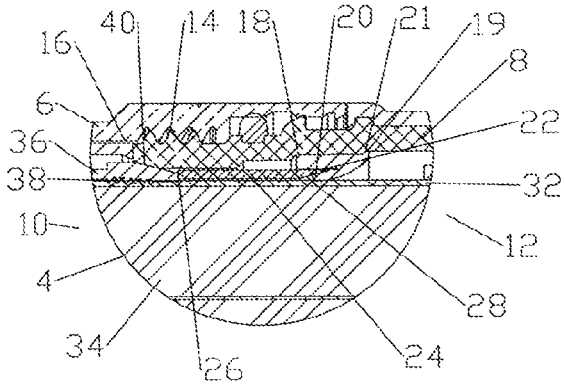
FIG. 4 is an expanded view of section B of FIG. 3.

Once the coaxial cable 4 is inserted, as shown for example in FIGS. 1 and 2, the clamp ring 8 may be further threaded towards the connector body 6 to finalize the interconnection, as shown for example in FIGS. 3 and 4. As the clamp ring 8 is advanced toward the connector body 6, the grip ring 36 advances the shim 24 into the gasket groove 22, the tapered shim end 28 contacting and displacing the radially inward protrusion 20 radially inward. Thereby, the radially inward protrusion 20 is displaced radially inward to contact the coaxial cable 4, sealing between the clamp ring 8 and an outer diameter of the coaxial cable 4.

Coupling the clamp ring 8 with the connector body 6 also displaces the grip ring 36 and the electrical contact 44 radially inward to contact the outer conductor 32, the displacement being proportional to an outer diameter of the outer conductor 32. The displacement of the grip ring 36 and the electrical contact 44, while both proportional to the diameter of the outer conductor 32, may be different depending upon the angle applied to the respective ramp surface 46 and tapered shim end 28. For example, because a compression characteristic of the electrical contact 44 may be higher than that of material of the gasket 18, the ramp surface 46 may have a larger angle than that applied to the tapered shim end 28.

For the coaxial connector 2 of the alternative exemplary embodiment of FIGS. 7 and 8, the outer conductor 32 may be manually flared to produce the flared portion after placing the coupling ring 8 and the shim 24 over the end of the coaxial cable 4 or alternatively integral flaring surfaces may be formed on the connector body and/or insulators supporting the inner contact.

One skilled in the art will appreciate that, because the contact between the tapered shim end 28 and the radially inward protrusion 20 is a direct circumferential contact, the radially inward bias created and quality of the environmental seal created thereby is both largely independent from the elastic qualities of the gasket 28 material and capable of adapting to a increased range of coaxial cable 4 outer diameters. In the case of the insertion coupling embodiment of FIGS. 1-6, the adaptation to the increased range of coaxial cable 4 outer diameters includes the mechanical and electrical interconnection, in addition to the environmental seal, each configurable by adapting the respective tapered and/or wedge surfaces driving these elements according to an elasticity and or compressibility characteristic of each.

Although the invention has been demonstrated with respect to coaxial cable 4 with a smooth outer conductor, one skilled in the art will also appreciate that the invention may be similarly applied to coaxial cable 4 with a corrugated outer conductor, such as an annular or helical corrugated outer conductor. The coaxial cable outer diameter variability enabled by the invention may be applied with respect to a single coaxial connector configuration usable upon a range of similar coaxial cables 4 that have either a smooth outer conductor or a corrugated outer conductor, significantly increasing the versatility of a single coaxial connector configuration.

Table of Parts

| | |
|---|---|
| 2 | coaxial connector |
| 4 | coaxial cable |
| 6 | connector body |

-continued

Table of Parts

| | |
|---|---|
| 8 | clamp ring |
| 10 | connector end |
| 12 | cable end |
| 14 | thread |
| 16 | bore |
| 18 | gasket |
| 19 | retention groove |
| 20 | radially inward protrusion |
| 21 | gasket flange |
| 22 | gasket groove |
| 24 | shim |
| 26 | base shim end |
| 28 | tapered shim end |
| 30 | jacket |
| 32 | outer conductor |
| 34 | insulator |
| 36 | grip ring |
| 38 | grip surface |
| 40 | wedge surface |
| 44 | electrical contact |
| 46 | ramp surface |
| 48 | flared portion |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A coaxial connector having a connector end and cable end, for interconnection with a coaxial cable, the coaxial connector comprising:

a connector body;

a clamp ring dimensioned to couple with a cable end of the connector body;

the clamp ring and the connector body provided with a bore along a longitudinal axis therethrough;

a gasket provided with a radially inward protrusion; the gasket coupled to an inner diameter of the clamp ring;

an outer diameter sidewall of the radially inward protrusion and an inner diameter sidewall of the gasket forming an annular gasket groove open to the connector end; and an annular shim seated within the bore; the shim inserts into the gasket groove, biasing the radially inward protrusion radially inward, as the clamp ring is advanced toward the connector body along the longitudinal axis.

2. The coaxial connector of claim 1, wherein the shim is provided with a tapered shim end; the tapered shim end tapering from a first inner diameter to a greater second inner diameter at a cable end of the shim.

3. The coaxial connector of claim 2, wherein the tapered shim end biases the radially inward protrusion against an outer diameter of an outer conductor of the coaxial cable when the shim is seated within the gasket groove.

4. The coaxial connector of claim 1, wherein the connector body and the clamp ring are coupled to each other by a thread; and the shim is advanced axially toward the gasket groove as the connector body and the clamp ring are threaded together.

5. The coaxial connector of claim 1, wherein the gasket has a sealed surface between the gasket and the inner diameter of the clamp ring and a dynamic surface between the gasket and an outer conductor of the coaxial cable.

6. The coaxial connector of claim 1, wherein a flared portion of an outer conductor of the coaxial cable is coupled between a connector end of the shim and a cable end of the connector body.

7. The coaxial connector of claim 1, further including a grip ring retained within the bore, an inner diameter of the grip ring provided with a grip surface, an outer diameter of the grip ring abutting a wedge surface of the clamp ring;

the wedge surface provided with a taper between a maximum diameter proximate the connector end and a minimum diameter proximate the cable end;

the grip surface dimensioned to receive the outer conductor from the cable end therethrough and couple with an outer diameter of the outer conductor; and the shim positioned between the grip ring and the gasket.

8. The coaxial connector of claim 7, wherein a base shim end of the shim abuts a cable end of the grip ring.

9. The coaxial connector of claim 7, wherein advancing the clamp ring axially toward the connector body displaces the grip ring radially inward to contact the outer conductor; and a displacement of the grip ring along the longitudinal axis is proportional to an outer diameter of the outer conductor.

10. The coaxial connector of claim 7, further including an electrical contact retained within the bore;

an inner diameter of the electrical contact coupled with an outer diameter of the outer conductor; and a ramp surface coupled with the electrical contact, the ramp surface driving the electrical contact radially inward proportional to a position of the clamp ring along the longitudinal axis.

11. The coaxial connector of claim 10, wherein the ramp surface is a portion of the clamp ring proximate the connector end of the clamp ring.

12. The coaxial connector of claim 10, wherein the electrical contact is a helical coil spring.

13. The coaxial connector of claim 10, wherein advancing the clamp ring axially toward the connector body displaces the grip ring and the electrical contact radially inward to contact the outer conductor; and the displacement of the grip ring and the electrical contact is proportional to an outer diameter of the outer conductor.

14. A method for interconnecting a coaxial connector with a coaxial cable, comprising the steps of:

inserting the coaxial cable through a cable end of a clamp ring, thereby bending a radially inward protrusion of a gasket seated within the clamp ring toward a connector end of the clamp ring to form an annular gasket groove between a sidewall of the radially inward protrusion and a sidewall of the gasket;

advancing the clamp ring towards a connector body, thereby driving an annular shim seated between the connector body and the gasket into the gasket groove, the shim displacing the radially inward protrusion radially inward.

15. The method of claim 14, wherein a base shim end of the shim clamps a flared leading edge of an outer conductor of the coaxial cable against a cable end of the connector body.

16. The method of claim 14, wherein the radially inward protrusion is displaced radially inward to contact the coaxial cable, sealing between the clamp ring and an outer diameter of the coaxial cable.

17. The method of claim 14, wherein the connector body and the clamp ring are provided with a thread; and the advance of the clamp ring towards the connector body is provided by threading together the clamp ring and the connector body.

18. The method of claim 14, wherein a grip ring is seated between the connector body and the shim, the grip ring driven radial inward against an outer conductor of the coaxial cable and abuting a base shim end of the shim when the clamp ring is coupled with the connector body.

19. The method of claim 18, wherein the coupling of the clamp ring with the connector body displaces the grip ring radially inward to contact the outer conductor; and an axial displacement of the grip ring towards the gasket is proportional to an outer diameter of the outer conductor.

20. The method of claim 18, further including an electrical contact;

the coupling of the clamp ring with the connector body displacing the grip ring and the electrical contact radially inward to contact an outer conductor of the coaxial cable; and wherein the displacement of the grip ring and the electrical contact is proportional to an outer diameter of the outer conductor.

* * * * *